US005354045A

United States Patent [19]

Boldrini et al.

[11] Patent Number: 5,354,045

[45] Date of Patent: Oct. 11, 1994

[54] DEVICE FOR FEEDING BLANKS TO A USER MACHINE

[75] Inventors: Fulvio Boldrini, Ferrara; Antonio Gamberini, Bologna, both of Italy

[73] Assignee: G.D. Societa' Per Azioni, Bologna, Italy

[21] Appl. No.: 36,511

[22] Filed: Mar. 24, 1993

[30] Foreign Application Priority Data

Mar. 26, 1992 [IT] Italy ..... B092A 000109

[51] Int. Cl.[5] ..... B65H 5/08

[52] U.S. Cl. ..... 271/11; 271/94; 271/31.1; 271/104; 271/108

[58] Field of Search ..... 271/11, 94, 104, 31.1, 271/108, 129

[56] References Cited

U.S. PATENT DOCUMENTS

| | | | |
|---|---|---|---|
| 3,904,190 | 9/1975 | Kuehn | 271/108 X |
| 3,976,421 | 8/1976 | Bernardi et al. | 271/94 |
| 4,260,146 | 4/1981 | Mitzel | 271/94 |
| 4,269,405 | 5/1981 | Mitzel | 271/94 |
| 4,758,126 | 7/1988 | Johnson et al. | 271/31.1 X |
| 4,822,234 | 4/1989 | Johnson et al. | 271/31.1 X |
| 5,121,914 | 6/1992 | Hargreaves | 271/265 X |

FOREIGN PATENT DOCUMENTS

| | | | |
|---|---|---|---|
| 0063833 | 11/1982 | European Pat. Off. . | |
| 3229278 | 2/1984 | Fed. Rep. of Germany . | |
| 3531145 | 3/1987 | Fed. Rep. of Germany | 271/31.1 |
| 3608067 | 9/1987 | Fed. Rep. of Germany | 271/104 |
| 3636935 | 5/1988 | Fed. Rep. of Germany . | |
| 2523099 | 9/1983 | France | 271/31.1 |

*Primary Examiner*—H. Grant Skaggs
*Assistant Examiner*—Carol L. Druzbick
*Attorney, Agent, or Firm*—Klauber & Jackson

[57] ABSTRACT

A device for feeding blanks to a user machine, whereby the end blank of a stack of blanks housed inside a feed-box is detached from the adjacent blanks in the stack by a separating roller, which feeds the blank, transversely in relation to the axis of the stack, to a withdrawal station where it is engaged by the periphery of a rotary suction member for withdrawing and feeding the blank to a user station.

9 Claims, 1 Drawing Sheet

Figure
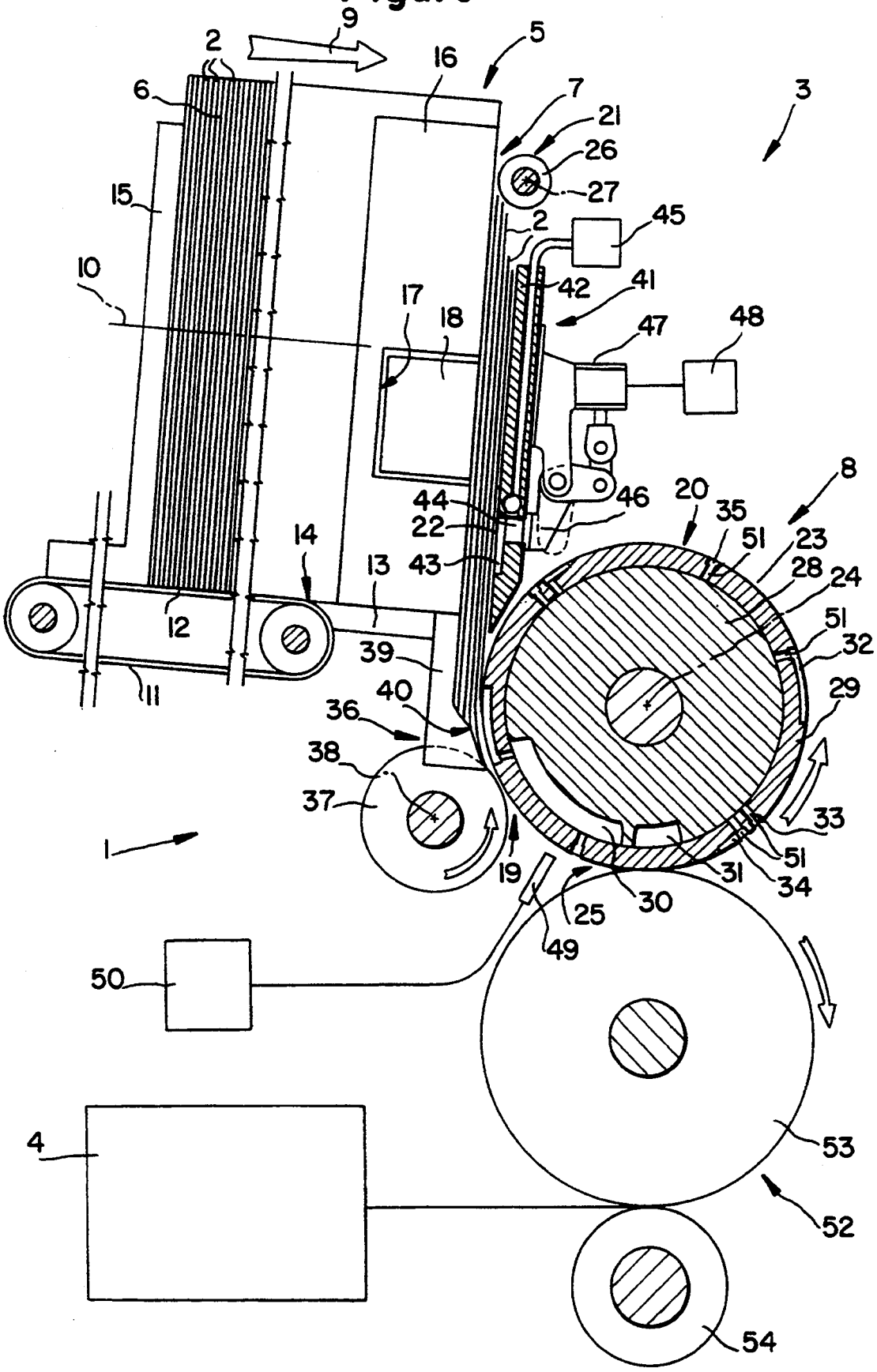

DEVICE FOR FEEDING BLANKS TO A USER MACHINE

BACKGROUND OF THE INVENTION

The present invention relates to a device for feeding blanks to a user machine.

For feeding blanks to a user machine, e.g. a packing machine for folding the blanks about respective products, a device is used comprising a feedbox, from one end of which the stacked blanks are withdrawn successively by a withdrawal device cooperating with a conveyor device by which the blanks are fed to a user station.

On known feed devices of the aforementioned type, the withdrawal device normally consists of a carriage moved linearly back and forth along a path substantially perpendicular to the axis of the stack, and supporting a suction sector. The sector is connected angularly to a gear in turn connected to a fixed rack, and is substantially tangent to the output end of the feedbox, so as to adhere by suction to the end blank in the stack and withdraw it from the feedbox by rotating about its axis as the carriage is moved linearly along said path.

At the end of the carriage stroke, the blank is fed to follow-up conveyor means, e.g. rollers, by which it is transferred to the user station.

Though efficient, the above known device presents a major drawback in terms of reliability, due to the relatively severe acceleration and deceleration to which the carriage supporting the suction sector is subjected when applied to user machines operated over and above a given speed in terms of blank throughput.

SUMMARY OF THE INVENTION

It is an object of the present invention to provide a blank feed device designed to function correctly at relatively high operating speeds.

According to the present invention, there is provided a device for feeding blanks to a user machine, the device comprising a feedbox for a stack of blanks, the feedbox presenting an output end; and a conveyor unit for successively withdrawing the blanks from said output end and feeding them to a user station; characterized by the fact that the conveyor unit comprises a blank withdrawal station offset in relation to said output end; thrust separating means cooperating with said stack for successively feeding the blanks from said output end to the withdrawal station along a first path; and means for withdrawing said blanks; said withdrawal means moving about a first fixed axis and along a second path substantially tangent to the first path at said withdrawal station and extending through said user station.

On the above device, as opposed to being withdrawn from the feedbox by a reciprocating withdrawal device, the blanks are pushed by the separating means from the output end of the feedbox to the withdrawal station, where they are gripped by withdrawal means simply rotating about a fixed axis, and fed to the user station, thus eliminating any acceleration or deceleration rendering known feed devices unsuitable for use alongside relatively fast-operating user machines.

Preferably, on the above device, the longitudinal axis of the stack is perpendicular to the blanks; and the thrust separating means comprise roller means substantially tangent to said output end and rotating about a second fixed axis for feeding the blanks to the withdrawal station along said first path, which extends in a direction substantially perpendicular to said longitudinal axis.

In particular, the withdrawal station preferably comprises stop means perpendicular to and defining one end of said first path; said second path being substantially tangent to the first path at said end of the first path.

BRIEF DESCRIPTION OF THE DRAWING

The present invention will be described with reference to the accompanying drawing showing a schematic, partially sectioned, partial block view of a preferred non-limiting embodiment.

DETAILED DESCRIPTION OF THE INVENTION

Number 1 in the accompanying drawing indicates a user machine fed with blanks 2 and having a feed device 3 by which blanks 2 are fed to a user station 4. Feed device 3 comprises a feedbox 5 housing a stack 6 of blanks 2 and having an output end 7 facing a blank conveyor unit 8 and to which blanks 2 are fed, inside feedbox 5, in direction 9 parallel to axis 10 of stack 6.

Blanks 2 are fed along feedbox 5 in direction 9 by a loop conveyor 11, one branch 12 of which, parallel to direction 9, combines with an adjacent plate 13 to define lateral wall 14 of feedbox 5, and is arranged contacting a lateral edge of each blank 2 in stack 6. For feeding blanks 2 in direction 9, branch 12 is fitted with and assisted by a pusher 15 parallel to blanks 2, and which provides for maintaining the blanks contacting one another and perpendicular to wall 14.

Feedbox 5 comprises a further two lateral walls 16 (only one of which is shown) perpendicular to wall 14 and on either side of stack 6. Close to output end 7, one of walls 16 presents an opening 17 engaged by a pusher 18, which cooperates laterally with blanks 2, in a direction perpendicular to the plane of the attached drawing, so as to push them on to the inner surface of the other wall 16.

Conveyor unit 8 comprises a withdrawal station 19 having means 20 for withdrawing blanks 2 fed successively from output end 7 by thrust separating means 21 cooperating with stack 6 and by which blanks 2 are fed along a first path 22 substantially perpendicular to axis 10 of stack 6.

Withdrawal means 20 consist of a suction roller 23 mounted for rotation about a first fixed axis 24 and the periphery of which travels along a second path 25 substantially tangent to first path 22 and extending from the end of first path 22 to user station 4.

Thrust separating means 21 comprise a separating roller 26 substantially tangent to the top portion of output end 7 of feedbox 5, and rotating about a second fixed axis 27 parallel to first fixed axis 24.

Suction roller 23 comprises a fixed drum 28 fitted coaxially to a hollow cylindrical body 29 rotating anticlockwise and defining a first portion of second path 25. Drum 28 presents a suction chamber 30, and a chamber 31 communicating with a compressed air source (not shown), and both chambers 30 and 31 are located successively along second path 25. Hollow cylindrical body 29 presents a number of chambers 32, 33, 34, 35, arranged likewise on both halves of body 29, the first 32 for retaining the leading portion of blank 2, the second and third 33 and 34 for retaining the central portion of blank 2, and the fourth 35 for retaining the end portion of blank 2.

Withdrawal station 19 also comprises stop means 36 substantially perpendicular to first path 22 and defining the bottom end of first path 22 from which second path 25 extends. Stop means 36 comprise a stop roller 37 rotating anticlockwise about a third fixed axis 38 parallel to and separated from first fixed axis 24 by a distance substantially equal to the radius of suction roller 23 plus the radius of stop roller 37 plus the thickness of blank 2.

Stop means 36 also comprise a stop block 39 located over, and adjacent to the periphery of, stop roller 37, and having a stop profile 40 sloping in relation to first path 22 and which provides for guiding blanks 2 towards the bottom end of path 22.

Withdrawal means 20 described above also comprise timing means 41 parallel to first path 22 and cooperating with withdrawal station 19. Timing means 41 consist of a retaining plate 42 parallel to first path 22 and in which is formed a suction chamber 43 connected by a conduit 44 to a suction source 45 and by the same conduit 44 to a valve 46 driven by an actuator 47 supplied with a signal by an electric control system 48.

In actual use, blanks 2 in stack 6 are placed on supporting surface 14 consisting of top branch 12 of belt 11 and plate 13, and are fed successively in direction 9 by conveyor belt 11 and pusher 15.

Blanks 2 thus slide towards output end 7 substantially contacting walls 16, and are packed neatly together against the wall 16 not shown in the drawing by the thrust exerted by pusher 18.

On issuing from output end 7, blanks 2 are separated by thrust separating means 21, which cooperate with stack 6 and feed blanks 2 successively to withdrawal station 19 along first path 22.

Roller 26 forming part of thrust separating means 21 feeds each blank 2 along first path 22 until it is arrested first on profile 40 of stop block 39 and then on stop roller 37 forming part of stop means 36, in which position blank 2 is retained by timing means 41 cooperating with withdrawal station 19.

Blank 2 is released by timing means 41 upon actuator 47 receiving a signal from control system 48 and connecting suction conduit 44 to the outside atmosphere by operating valve 46.

The signal is so supplied by control system 48 to actuator 47 as to release blanks 2 at a given phase and frequency, which are controlled by a detector 49 along second path 25, for detecting any irregularity in the position of blank 2, which, via a control device 50, is corrected by control system 48 anticipating or delaying the signal to actuator 47.

Upon conduit 44 being connected to the atmosphere, thus cutting off suction inside chamber 43 in retaining plate 42, blank 2 is retained by withdrawal means 20 and more specifically by hollow cylindrical body 29 of suction roller 23, first via first chamber 32 and then successively via chambers 33, 34 and 35, which are connected by respective conduits 51 to suction chamber 30.

Blank 2 is thus withdrawn on to an outer arc of hollow cylindrical body 29 and fed along second path 25, which terminates upon conduits 51 communicating with chamber 31 in fixed drum 28 and upon chambers 32, 33, 34 and 35 communicating successively with said compressed air source (not shown), which provides for troublefree detachment of blank 2 off hollow cylindrical body 29.

Blank 2 is then fed on to conveyor means 52, comprising a roller 53 and counter-roller 54, by which it is fed to user station 4.

The present invention thus provides for a device designed to adapt to even very high operating speeds, without incurring the drawbacks typically associated with known devices.

In addition to the cost advantages of the present invention, it is also extremely straightforward in design as compared with known devices, the reciprocating movement of which necessarily requires the use of complex, high-cost mechanisms.

We claim:

1. A device (3) for feeding blanks (2) to a user machine (1), the device (3) comprising a feedbox (5) for a stack (6) of blanks (2), the feedbox (5) having an output end (7); and a conveyor unit (8) for successively withdrawing the blanks (2) from said output end (7) and feeding them to a user station (4); the conveyor unit (8) comprising a blank withdrawal station (19) offset in relation to said output end (7); thrust separating means (21) cooperating with said stack (6) for successively feeding the blanks (2) from said output end (7) to the withdrawal station (19) along a first path (22); means (20) for withdrawing said blanks (2); said withdrawing means (20) moving about a first fixed axis (24) and along a second path (25) substantially tangent to the first path (22) at said withdrawal station (19) and extending through said user station (4); and timing means (41) cooperating with the withdrawal station (19) at a given phase and frequency; said timing means (41) being parallel to said first path (22), cooperating with the withdrawal station (19), and comprising a stationary retaining plate (42) parallel to the first path (22), suction means (43, 44, 45) extending through the retaining plate (42), and valve means (46, 47, 48) controlling the suction means (43, 44, 45).

2. A device as claimed in claim 1, wherein said stack (6) has an axis (10) which is perpendicular to said blanks (2); said thrust separating means (21) comprising roller means (26) substantially tangent to said output end (7) and rotating about a second fixed axis (27) for feeding the blanks (2) to said withdrawal station (19) along said first path (22), which extends in a direction substantially perpendicular to said axis (10).

3. A device as claimed in claim 2, wherein said withdrawal station (19) comprises stop means (36) perpendicular to, and defining one end of, said first path (22); said second path (25) being substantially tangent to the first path (22) at said end of the same.

4. A device as claimed in claim 3, wherein said stop means (36) comprise a stop roller (37) rotating in the same direction as said withdrawal means (20) and about a third axis (38) parallel to said first and second axes (24, 27).

5. A device as claimed in claim 4, wherein said stop means (36) further comprise a stop block (39) adjacent to the periphery of said stop roller (37) and upstream from the stop roller (37) along said first path (22); the stop block (39) presenting a stop shoulder (40) sloping in relation to said first path (22) and towards the periphery of the stop roller (37).

6. A device as claimed in claim 1, wherein said withdrawal means (20) comprise a suction roller (23) mounted for rotation about said first axis ( 24 ) and substantially tangent to said first path (22).

7. A device as claimed in claim 6, wherein said suction roller (23) defines a first portion of said second path (25), and is provided with a succession of peripheral chambers (32, 33, 34, 35) adapted to be advanced along the second path (25) and to retain a leading portion, a central portion, and end portion respectively of a blank (2).

8. A device as claimed in claim 7, further comprising a vacuum source means (30) and a pressure source means (31) associated with said suction roller (23) and selectively communicating with said chambers (33, 34, 35, 36) to retain and, respectively, release said blank (2).

9. A device as claimed in claim 1, wherein the suction means (43, 44, 45) comprise a suction chamber (43) facing the withdrawal station (19), a suction source (45), and a conduit (44) connecting the suction chamber (43) to the suction source (45); said valve means (46, 47, 48) being discharge valve means arranged along said conduit (44).

* * * * *

UNITED STATES PATENT AND TRADEMARK OFFICE

CERTIFICATE OF CORRECTION

PATENT NO. : 5,354,045

DATED : OCTOBER 11, 1994

INVENTOR(S) : FULVIO BOLDRINI AND ANTONIO GAMBERINI

It is certified that error appears in the above-indentified patent and that said Letters Patent is hereby corrected as shown below:

On the title page, item [73] should read:

— G.D SOCIETA' PER AZIONI —

Signed and Sealed this

Second Day of May, 1995

*Attest:*

Bruce Lehman

BRUCE LEHMAN

*Attesting Officer*

*Commissioner of Patents and Trademarks*